US008376507B2

(12) United States Patent
Friedmann et al.

(10) Patent No.: US 8,376,507 B2
(45) Date of Patent: Feb. 19, 2013

(54) NON-CONTACT INKJET PRINT HEAD CLEANING

(75) Inventors: Edgar Friedmann, Ramat-Gan (IL); Lev Superfin, Netanya (IL); Semion Gengrinovich, Ramat Gan (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 172 days.

(21) Appl. No.: 13/045,008

(22) Filed: Mar. 10, 2011

(65) Prior Publication Data

US 2012/0229562 A1 Sep. 13, 2012

(51) Int. Cl.
*B41J 2/165* (2006.01)

(52) U.S. Cl. ..... 347/25; 347/30

(58) Field of Classification Search ..... 347/20, 347/22, 23, 25, 30
See application file for complete search history.

(56) References Cited

U.S. PATENT DOCUMENTS

| | | | | |
|---|---|---|---|---|
| 4,970,535 | A * | 11/1990 | Oswald et al. | 347/25 |
| 5,138,334 | A * | 8/1992 | Rowe et al. | 347/25 |
| 6,398,345 | B1 | 6/2002 | Sakai et al. | |
| 6,869,161 | B2 | 3/2005 | Wouters et al. | |
| 7,004,559 | B2 | 2/2006 | Aliaga | |
| 7,703,412 | B2 | 4/2010 | Iwata | |

* cited by examiner

*Primary Examiner* — Lamson Nguyen

(57) ABSTRACT

In one embodiment, a non-contact print head cleaning device includes an elongated cavity underlying a print head and a vacuum port connected to the elongated cavity and generating a low pressure in the elongated cavity. A slot in a wall of the elongated cavity has a geometry that varies along its length to produce an airflow with a substantially uniform velocity into the slot. The airflow sucks contaminants off the print head into the slot. A method for non-contact print head cleaning is also provided.

20 Claims, 9 Drawing Sheets

NON-CONTACT INKJET PRINT HEAD CLEANING

BACKGROUND

Inkjet printing is a versatile method for recording images on various media surfaces for a number of reasons. Inkjet printing can have a number of advantages including low cost, low printer noise, capability for high speed printing, and multicolor recording. Inkjet printing can deposit a variety of ink types including pigment based aqueous inks, dye based solvent inks, and ultra-violet (UV) curing inks. UV curing inks can be particularly useful for durable inkjet printing on coated or nonporous substrates.

Inkjet printing involves forcing very small ink droplets out of an array of nozzles in a nozzle plate with controlled timing, velocity, and direction. The ink droplets impact the substrate to create the desired image. The quality of the print produced by an inkjet printer depends at least partially on the state of the nozzle plate. A nozzle plate that is dry and free from debris enables accurate droplet placement. Accurate droplet placement reduces printing artifacts created by misdirected droplets. However, it can be difficult to maintain the dry and clean state of the nozzle plate. Ink mist formed during droplet ejection may contact the nozzle plate surface. Further, dust, paper residues, and fabric lint may collect on the nozzle plate surface.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Inkjet printing is a versatile method for recording images on various media surfaces for a number of reasons, including low cost, low printer noise, capability for high speed printing, and multicolor recording. Inkjet printing can deposit a variety of ink types including pigment based aqueous inks, dye based solvent inks, and UV curing inks. UV curing inks can be particularly useful for durable inkjet printing on coated or nonporous substrates.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Figure 1A:
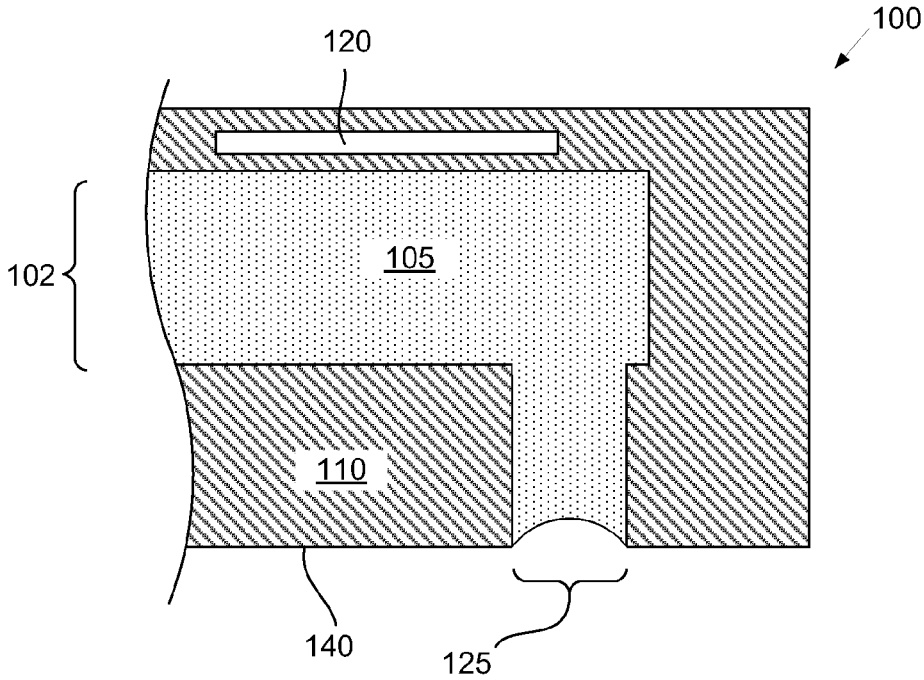
FIGS. 1A and 1B are diagrams of one illustrative inkjet firing chamber and nozzle, according to one example of principles described herein.
Figure 1B:
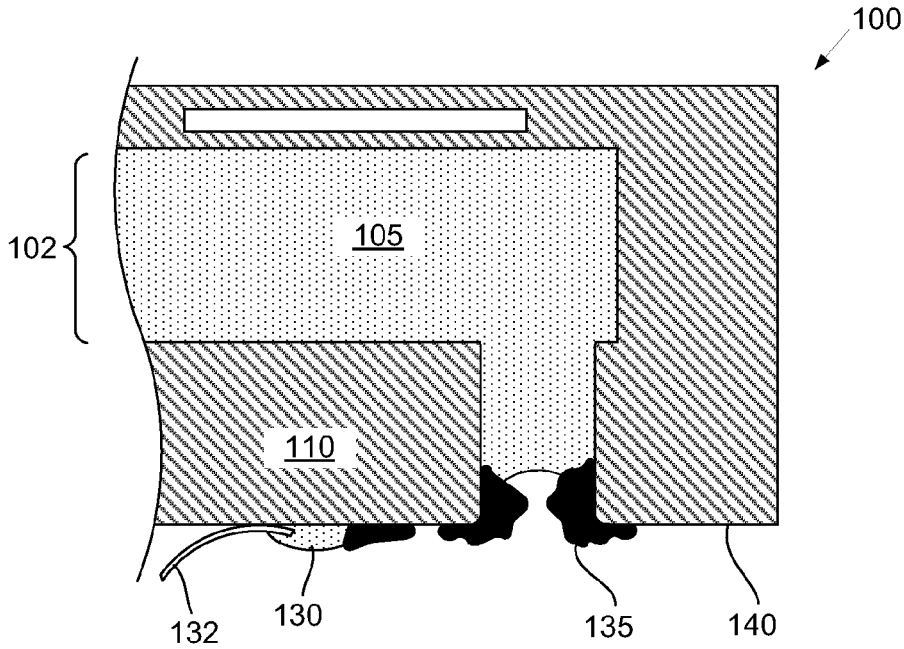

FIGS. 1A and 1B are diagrams of an illustrative inkjet firing chamber and nozzle. FIG. 1A is a cross-sectional diagram of a portion of an inkjet print head (100) that includes a firing chamber (102), transducer (120) and nozzle (125). The nozzle (125) is formed in a nozzle plate (110). The inkjet operates by sending an electrical signal through the transducer (120).

The transducer (120) may be any of a number of transducers that convert electrical energy into mechanical energy. For example, the transducer (120) may be a heater that rapidly vaporizes a small portion of the ink (105). This forms a rapidly expanding bubble that forces a predetermined amount of ink (105) out of the nozzle (125). Alternatively, the transducer (120) may be a piezo-electric element that rapidly changes shape when electricity is applied. This mechanical motion ejects an ink droplet from the nozzle. Piezo transducers have a number of advantages, including the ability to use a wide range of inks. For example, piezo transducers can dispense inks that do not have volatile components, such as UV curing inks. UV curing inks may include polymer precursors that are cured after printing by exposure to UV light. The UV curable inks cure quickly, can be applied to a wide range of substrates, and produce a very high quality and robust image.

As discussed above, inkjet printing involves forcing very small ink droplets out of an array of nozzles (125) in the nozzle plate (110) with controlled timing, velocity, and direction. The ink droplets impact the substrate to create the desired image on the substrate.

The quality of the print produced by an inkjet printer to a large extent depends on the state of the nozzle plate (110) and especially the surface (140) of the nozzle plate. A nozzle plate (110) which is dry and free of debris enables accurate droplet placement. Accurate droplet placement reduces printing artifacts caused by misdirected ink droplets.

However, it can be difficult to keep the nozzle plate surface (140) dry and free of debris. FIG. 1B shows a contaminated nozzle plate surface (140) which includes an ink droplet (130) created by ink mist generated during droplet ejection. Various lint (132), dust, and ink particulates (135) are also present on the surface (140). The lint and dust may be generated during the printing process or transferred from the substrate to the surface (140). If the nozzle (125) is blocked, subsequent firing of inkjet may not result in ink droplets being ejected. If the nozzle shape or size is altered, the ejected ink droplets may not be the desired size or have the desired trajectory. This can result in print defects that lower the quality of the image produced by the inkjet printer.

In printing environments where UV cured inkjet ink is used, ink droplets on the nozzle plate surface can be cured by stray UV light. The ink droplets then become strongly polymerized and resistant to abrasion and solvents. These droplets (130) can be unsightly and interfere with proper function of the inkjet print heads. Thus, removal of the ink droplets on the nozzle plate surface prior to curing can preserve the functionality the print head and reduce maintenance costs.

A number of different coatings to reduce nozzle plate surface wetting and static attraction have been developed, although only repetitive and frequent nozzle plate surface cleaning helps to maintain correct operating status of the nozzle plate. Contact cleaning methods typically rely on a simple wiping process, where a soft blade, such as one made from a fluoro-silicone, periodically wipes the excess ink from the nozzle plate. In general, contact cleaning techniques are not desirable for UV curing inks. For example, UV ink on the cleaning blade may eventually cure, making the cleaning blade rigid and abrasive.

Figure 2:
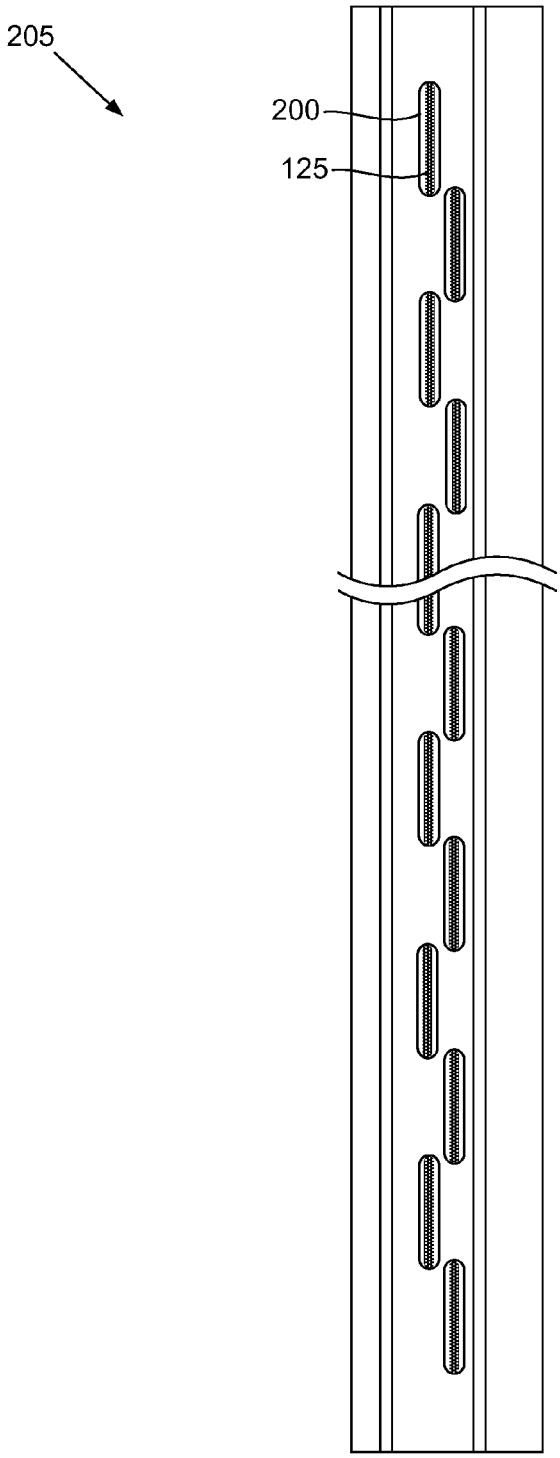
FIG. 2 is a bottom view of an illustrative array of inkjet print heads on an inkjet print bar, according to one example of principles described herein.

FIG. 2 is a bottom view of an array of inkjet print heads (200) on an inkjet print bar (205). Each of the printheads (200) includes a nozzle plate with an array of nozzles (125). The print head (200) and substrate are moved relative to each other so that the print head (200) covers the desired surface area of the substrate. For large format or low pass printing, the print bar (205) may include an array print heads which span the entire width of the substrate. For example, the HP Scitex 7500 flat bed printer includes a stationary inkjet printing unit. Substrates up to 25 millimeters thick and as large as 1.65 meters by 3.2 meters are moved beneath the stationary printing unit. The printing unit includes multiple print bars (205) with hundreds of inkjet print heads. Each of the print bars (205) spans the width of the substrate and allows the entire surface of the substrate receive ink during a single pass. In one implementation, a wide format Scitex 7500 printer includes 312 drop-on-demand piezoelectric print heads with a combined total of almost 40,000 inkjet nozzles.

As discussed above, regular cleaning of the inkjet nozzles prevents nozzle clogging, deflected droplets and the accumulation of dried ink. The used of mechanical wipers to nozzle plates has a number of disadvantages, including cross contamination and progressive wear of both the wiper and the nozzle plate. Spraying a cleaning solution on the nozzle plate also has disadvantages including incorporating additional fluid handling equipment into the printer and collection and disposal of the used cleaning solution. A non-contact print head cleaning device is desirable to avoid cross contamination and abrasion of the nozzle plate.

Figure 3A:
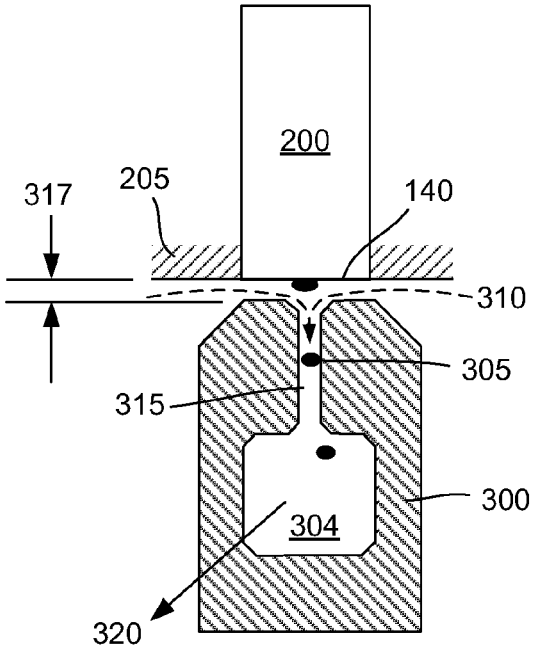
FIG. 3A is a cross sectional diagram of an illustrative vacuum cleaning device and print head, according to one example of principles described herein.

In one illustrative example, a vacuum cleaning device provides non-contact cleaning of multiple print heads. FIG. 3A is a cross sectional diagram of an illustrative vacuum cleaning device (300) and a print head (200). The vacuum device (300) includes an elongated cavity (304) that is connected to a vacuum port. A slot (315) is made in the upper side of the elongated cavity (304). The vacuum port sucks air out of the elongated cavity (304). This creates lower pressures in the elongated cavity (304). The difference between the lower pressures in the elongated cavity (304) and the higher atmospheric pressure creates a pressure gradient that draws the atmospheric air (310) into the slot (315). The air flow (310) dislodges contaminants (315) from the nozzle plate (140) of the printhead (200) and carries them into the elongated cavity (304). After entering the elongated cavity (304), the contaminants (315) and air flow pass along the length of the cavity (304) as shown by the arrow (320) and exit through a vacuum port at one end of the vacuum device (300).

As shown in FIG. 3A, the vacuum cleaning device (300) does not contact the print head (200). Instead, the vacuum cleaning device (300) maintains a predetermined distance (317) between its surface and the nozzle plate (140) of the print head (200). For example, the predetermined distance (317) may be from about 0.2 millimeters to about 1 millimeter. The vacuum generated in the elongated cavity (304) may be approximately −0.5 Barr. The narrow passage between the upper surface of the vacuum device (300) and the nozzle plate (140) confines the air flow (310) and improves the debris removal capabilities of the air flow. In this particular implementation, the vacuum pump is adjusted so that the speed of the air flow into the slot is approximately 7.5-10 meters per second. The external shape of the vacuum cleaning device (300) can be used to influence the characteristics of the air flow (310). For example, smoother external shapes may minimize air flow disturbances, while discontinuities may increase turbulence.

Figure 3B:
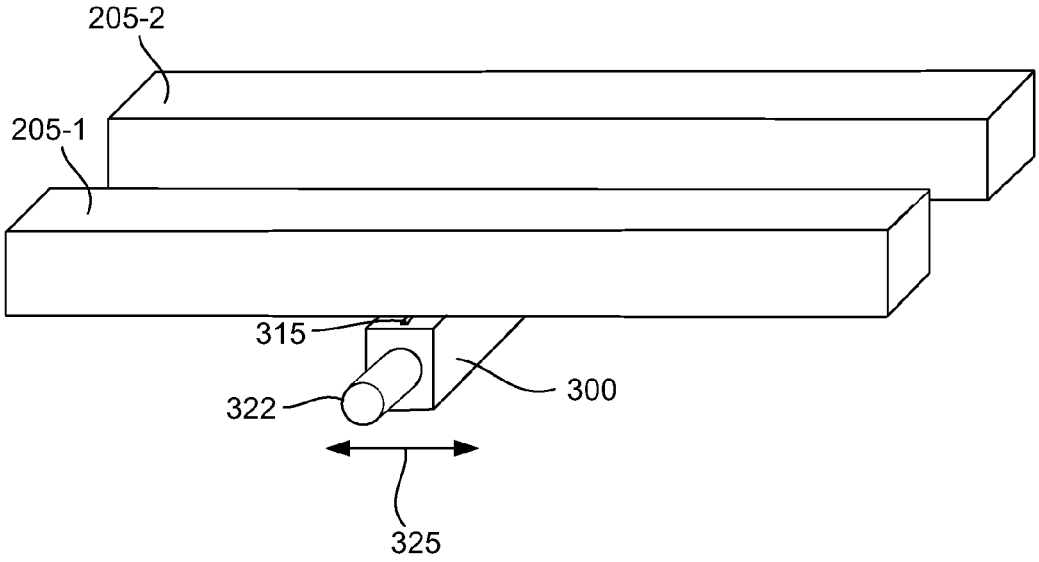
FIG. 3B is a perspective view of an illustrative vacuum cleaning device cleaning print heads on multiple print bars, according to one example of principles described herein.

FIG. 3B is a perspective view of an illustrative vacuum cleaning device (300) cleaning print heads on multiple print bars (205-1, 205-2). In this example, the vacuum cleaning device (300) is placed underneath and perpendicular to the print bars (205-1, 205-2). During the cleaning process, the print bars (205-1, 205-2) may remain stationary while the vacuum cleaning device (300) moves back and forth as shown by the double headed arrow (325) or vice versa. In one example, the speed of the relative movement between the surface of the print bars (205-1, 205-2) and the slot is about 3 centimeters per second. The back and forth scanning of the vacuum cleaning device (300) under the print bars (205-1, 205-2) allows for all the print heads (200, FIG. 3A) spaced along the bars (205) to be cleaned. Additionally, the vacuum cleaning device (300) may make multiple passes over the print bars (205) to ensure through cleaning.

In FIG. 3B, the slot (315) is illustrated as being perpendicular to the long axis of the print bars (205). However, the vacuum device (300) may be arranged in a variety of other orientations. For example, the vacuum device (300) may be parallel or at an angle to the long axis of the print bars (205).

The vacuum cleaning device (300) has a number of advantages including non-contact cleaning, direct disposal of particulates and fluids, and no cross contamination between print heads. Further, the vacuum cleaning device (300) can quickly clean a large number of print heads. In some implementations, the vacuum cleaning device may use a single vacuum port (322) located at one end of the elongated cavity. Alternatively, the vacuum cleaning device may have a plurality of vacuum ports spaced along the bottom, ends, or sides of the vacuum cleaning device. The plurality of vacuum ports may be connected to a vacuum manifold. A single vacuum port may have a number of advantages, including lower cost, smaller overall size, and less interference with scanning mechanisms. Additionally, the single vacuum port can be larger than multiple vacuum ports. This can result in a lower likelihood of blockage.

Figure 4A:
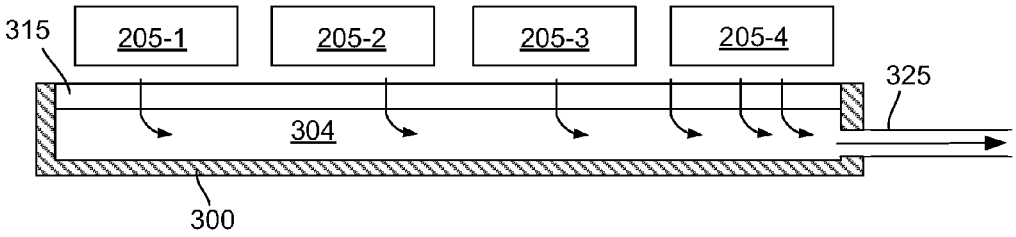
FIG. 4A is cross-sectional diagram of an illustrative vacuum cleaning device with a uniform slot in the top, according to one example of principles described herein.

However, the use of a single vacuum port with a uniform slot can result in non-uniform air flow along the length of the slot (315). The term "uniform slot" refers to a slot which has a substantially identical cross section along its length. FIG. 4A is cross-sectional diagram of a vacuum cleaning device (300) with a uniform slot (315) in the top. The vacuum device (300) spans a number of print bars (205). The vacuum port (325) is on one end of the elongated channel (304). A uniform slot (315) runs through the upper surface of the vacuum cleaning device (300) and connects the elongated cavity (304) to outside atmosphere. When a vacuum is applied to the elongated cavity (304) by the vacuum port (325), more air flow enters the slot (315) near the vacuum port (325). This creates a disparity in the cleaning power of the cleaning device (300) along its length. The slower air flows and lower air flow volumes at the opposite end of the slot (315) can be less effective in removing contaminants. For example, in the implementation shown in FIG. 4A, nozzle plates on the right-most print bar (205-4) are more vigorously cleaned than the left most print bar (205-1).

Figure 4B:
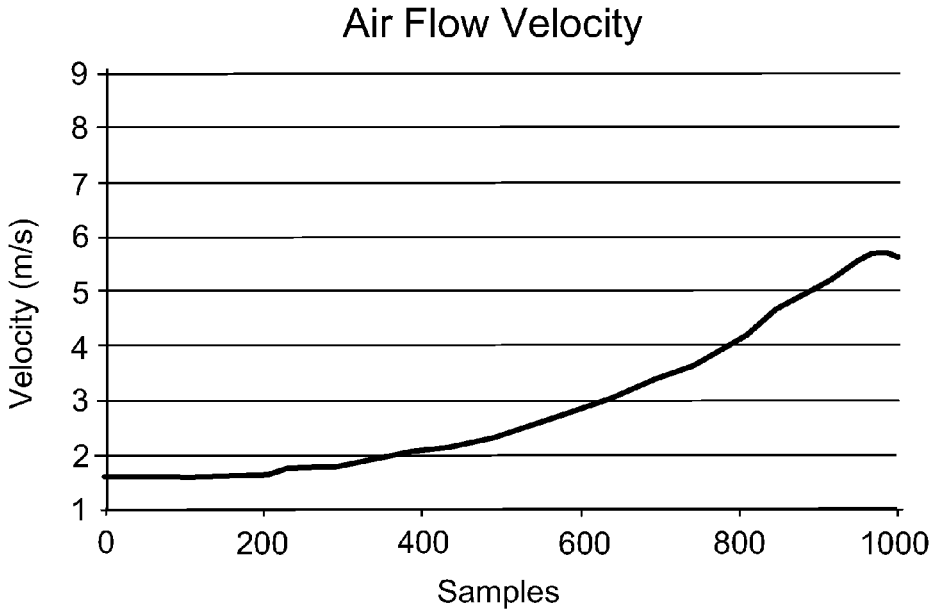
FIG. 4B is a graph of air velocity through the uniform slot in an illustrative vacuum cleaning device, according to one example of principles described herein.

Measurements of the air flow velocities entering the cleaning device shown in FIG. 4A confirm that there can be a substantial disparity in the air flow velocities along the length of the slot. FIG. 4B is a graph that shows air flow velocities between 1 meter per second and 9 meters per second along the vertical axis. The horizontal axis shows data samples that were taken along the length of the slot. The samples correspond to different sequential distances along the slot, starting at positions that are farthest away from the vacuum port at the left of the graph and moving toward the vacuum port across the graph.

As shown by the data, the air flow velocity changes significantly over the length of the slot, with low velocities (about 1.6 meters per second) occurring at points that are most distant from the vacuum port. The velocity increases the closer to the vacuum port the measurements were taken. For example, at sample 400, the air flow velocity is approximately 2 meters per second. At sample 800, the air flow velocity is approximately 4 meters per second. The maximum air flow is about 5.7 meters per second. As discussed above, the lower velocity air flow will be less effective in removing contaminants than the higher velocity air flow.

A variety of approaches could be used to increase the uniformity of the air flow into the slot. For example, the location of the vacuum port could be shifted to the center of the vacuum device. This can lead to an increase in the width of the vacuum device. This increased width may interfere with the scanning of the vacuum device and/or require an increase in the size of the scanning mechanism. In another implementation, multiple vacuum ports could be located along the bottom of the vacuum device. This allows for air to be drawn into the slot and directly down into the vacuum ports. While this may improve the uniformity of air flow into the slot, the multiple smaller vacuum ports can substantially increase the overall envelope of the vacuum device and clearance space required to scan the vacuum device along the length of the print bars. Additionally, the multiple vacuum ports introduce more aerodynamic losses and may become blocked more easily. Consequently, it can be desirable to minimize the size, aerodynamic losses, and structural complexity of the vacuum cleaning device by using a single large diameter vacuum port located at one end of the vacuum device.

Figure 5A:
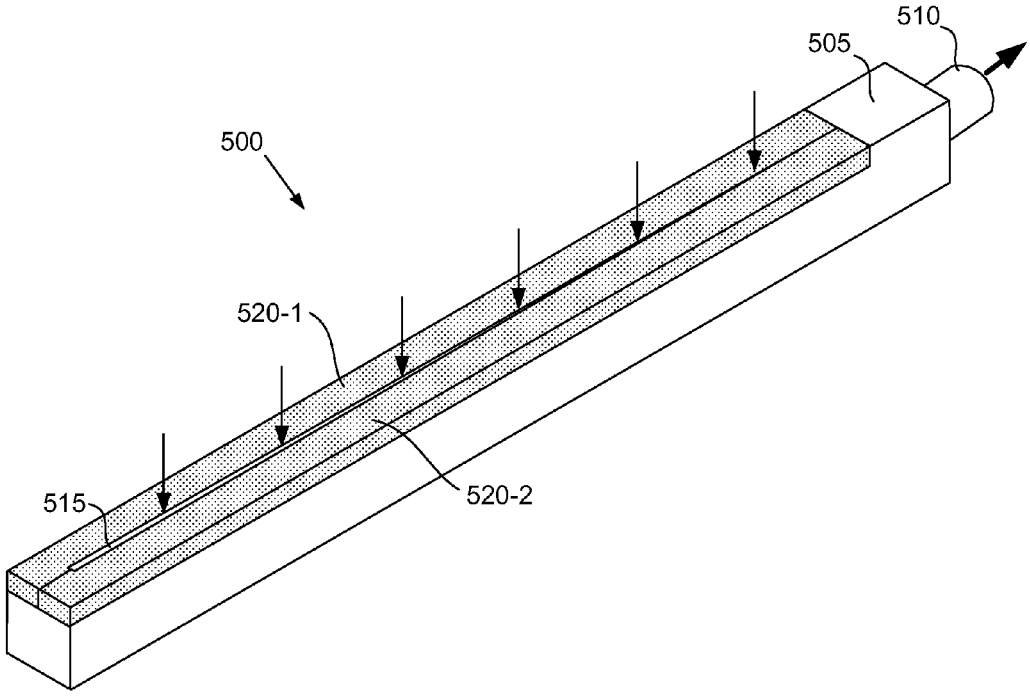
FIG. 5A is a perspective diagram of a non-uniform slot in an illustrative vacuum cleaning device, according to one example of principles described herein.

According to one illustrative implementation, one or more dimensions of the slot are varied along its length to produce more uniform air flow velocities into the slot. FIG. 5A is a perspective diagram of a non-uniform slot (515) in a vacuum cleaning device (500). As used in the specification and appended claims, the term "non-uniform slot" refers to a slot in which one or more of the slot dimensions varies along the length of the slot. For example, one or more of the width, depth, and taper angle of the slot could vary along its length.

The illustrative vacuum cleaning device (500) includes a body (505) with a vacuum port (510) connected to one end. The body contains an elongated cavity that is connected to the vacuum port (510). Two plates (520-1, 520-2) are placed over an open side of the elongated cavity and create a non-uniform slot (515). In this example, the slot (515) is both narrower and deeper near the vacuum port (510) and becomes wider and shallower as it nears the opposite end of the device. As discussed above, air is pulled through the vacuum port (510) to create low pressure inside the elongated channel. The low pressure in the channel pulls air through the non-uniform slot (515) and into the elongated channel. This non-uniform slot geometry provides for substantially uniform air flow velocities along the length of the slot (515).

Figure 5B:
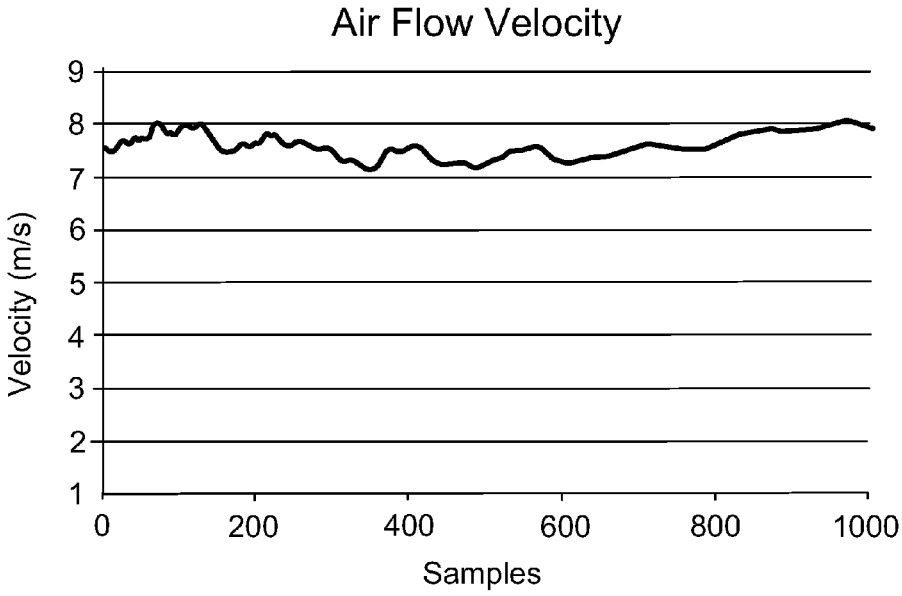
FIG. 5B is a graph of air flow velocity through the non-uniform slot in an illustrative vacuum cleaning device, according to one example of principles described herein.

FIG. 5B is a graph of air velocity through the non-uniform slot (515, FIG. 5A) in the vacuum cleaning device (500). The graph shows air flow velocities between 1 meter per second and 9 meters per second along the vertical axis and data samples taken along the length of the slot in the horizontal axis. The data shows that the air flow velocities are substantially uniform along the length of the non-uniform slot. The variation in the air flow velocities is between 8 meters per second and 7 meters per second, or about ±0.5 meters per second. This substantially uniform velocity can more effectively clean nozzle plates along the entire length of the slot.

Figure 6A:
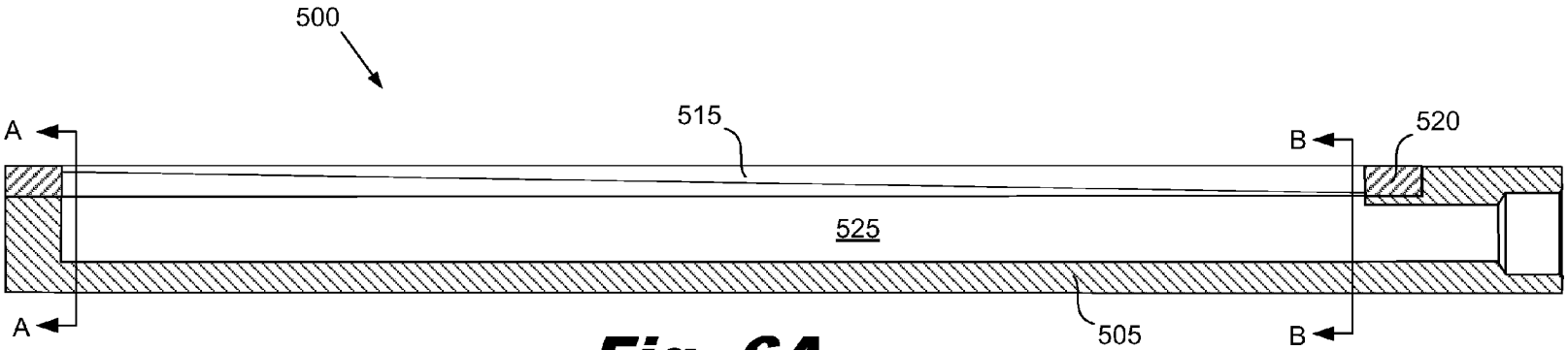
FIGS. 6A-E are diagrams of an illustrative vacuum cleaning device with a non-uniform slot, according to one example of principles described herein.

FIGS. 6A-6E are cross sectional diagrams of an illustrative vacuum cleaning device (500) with a non-uniform slot (515). FIG. 6A is a cross sectional diagram taken through the slot (515) along the length of the device (500). As discussed above, an elongated cavity (525) passes through the center of the body (505). The body (505) is open on the top side and two plates (520) cover the opening. A gap between the plates (520) creates the slot (515).

Figure 6B:
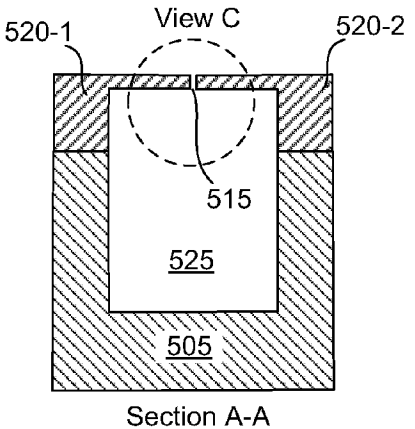
Figure 6C:
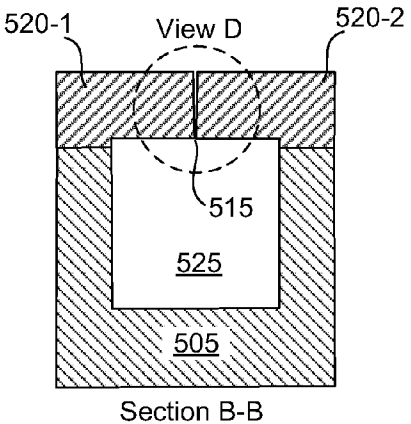

FIGS. 6B and 6C are cross sectional views taken along lines A-A and B-B respectively. FIG. 6B shows the cross section of the device near the tip of the device (500). At this point, the slot (515) is relatively wide and shallow. In this example, the width of the slot is created by removing a portion of the edge of each of the plates (520). The more material that is removed from the edges of the plates (520), the wider of the slot (515). In other examples, the material may be removed from only one plate. The depth of the slot (515) depends on the thickness of the plate edges. In this example, the slot (515) is shallow because the under portion of the plates (520) has been removed to reduce the thickness of the plate edges.

FIG. 6C is a cross sectional diagram of the vacuum device (500) near the vacuum port. At this point, the slot (515) is narrow, deep, and tapered. As discussed above, the slot (515) is created by the geometry of the two adjacent sides of the plates (520-1, 520-2). Only a small portion of the edges of the plates (520-1, 520-2) have been removed, with more material being removed at the top than at the bottom.

Figure 6E:
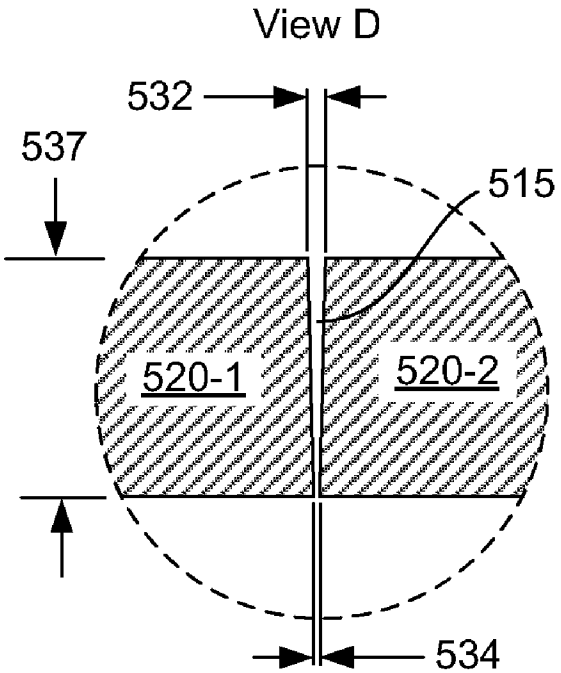
Figure 6D:
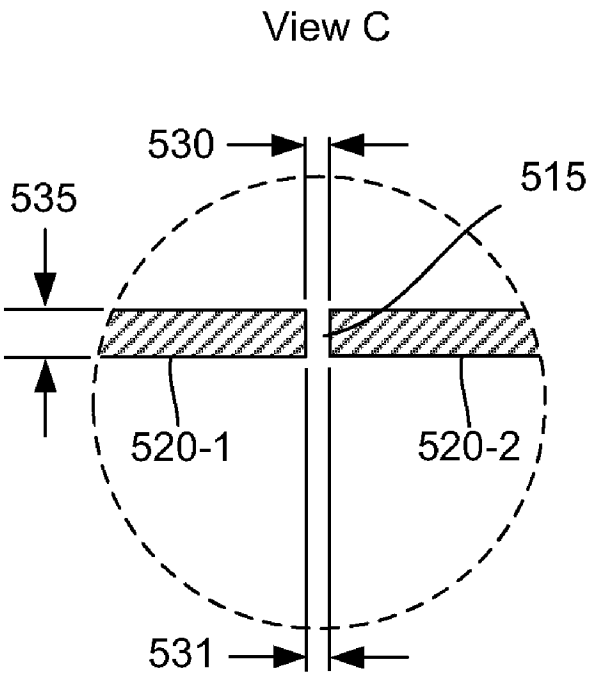

FIG. 6D is a detail view taken from the cross sectional diagram in FIG. 6B. As discussed above, the slot (515) is formed by a gap between the edges of the plates (520-1, 520-2). The slot (515) has an upper width (530), a lower width (531) and a depth (535). According to one implementation, widest portion of the slot (515) is less than 2 millimeters in width. For example, the upper width (530) of the slot (515) may be approximately 1 millimeter and the lower width (531) of the slot (515) may be approximately 0.96 millimeters. The taper of the slot (515) may be approximately 1 degree. The depth (535) of the slot (515) may be slightly greater than 2 millimeters.

FIG. 6E is a detail view taken from the cross sectional diagram in FIG. 6C. As discussed above, the slot (515) at this point is narrower, deeper and more tapered the portion of the slot (515) shown in FIG. 6D. In one implementation, the upper width (532) may be approximately 0.5 millimeters and the lower width (534) may be approximately 0.3 millimeters. The depth (537) of the slot may be approximately 9 millimeters. The taper angle between the top and bottom of the slot (515) may be approximately 1 degree.

Consequently, the depth to width ratio of the slot is between approximately 2:1 and 10:1, with the lower depth to width ratio being farther away from the vacuum port and the higher depth to width ratio being near the vacuum port. Further, the predetermined distance (317, FIG. 3A) may be of approximately the same order of magnitude as the slot width.

In general, one or more of the dimensions of the slots can be varied to increase the uniformity of air flow velocity into the slot (515). In one example, the geometry of the slot gradually and continuously changes down the length of the device. The slot gets progressively wider and shallower farther away from the vacuum port. Thus, air entering the slot near the vacuum port faces higher aerodynamic resistance than air entering the slot at the opposite end. This higher aerodynamic resistance compensates for the changes in pressure that occur along the length of the elongated cavity. The lowest pressure in the elongated cavity is near the vacuum port. This low pressure creates a larger pressure gradient that aggressively pulls air into the slot near the vacuum port. However, the higher aerodynamic resistance of the slot near the vacuum port at least partially compensates for the more aggressive pressure gradient. Farther away from the vacuum port the slot becomes wider and shallower, with decreased aerodynamic resistance. This at least partially compensates for the higher pressures away from the vacuum port. As discussed above, the depth and width of the slot can be change along its length. Additionally the taper angle can change along the length of the slot. In some examples, the dimensions may vary linearly with distance. In other examples, the dimensions may vary in a non-linear or stepwise fashion.

Further, the distance between the slot and the nozzle plates, slot displacement speed, level of vacuum and other factors may all be adjusted to provide the desired cleaning of the print heads. A non-uniform slot that generates uniform air flow velocities can be more effective in removing contaminates. Consequently, the size, capacity, and energy consumption of the vacuum generating apparatus can be reduced compared to devices with a uniform slot.

Figure 7:
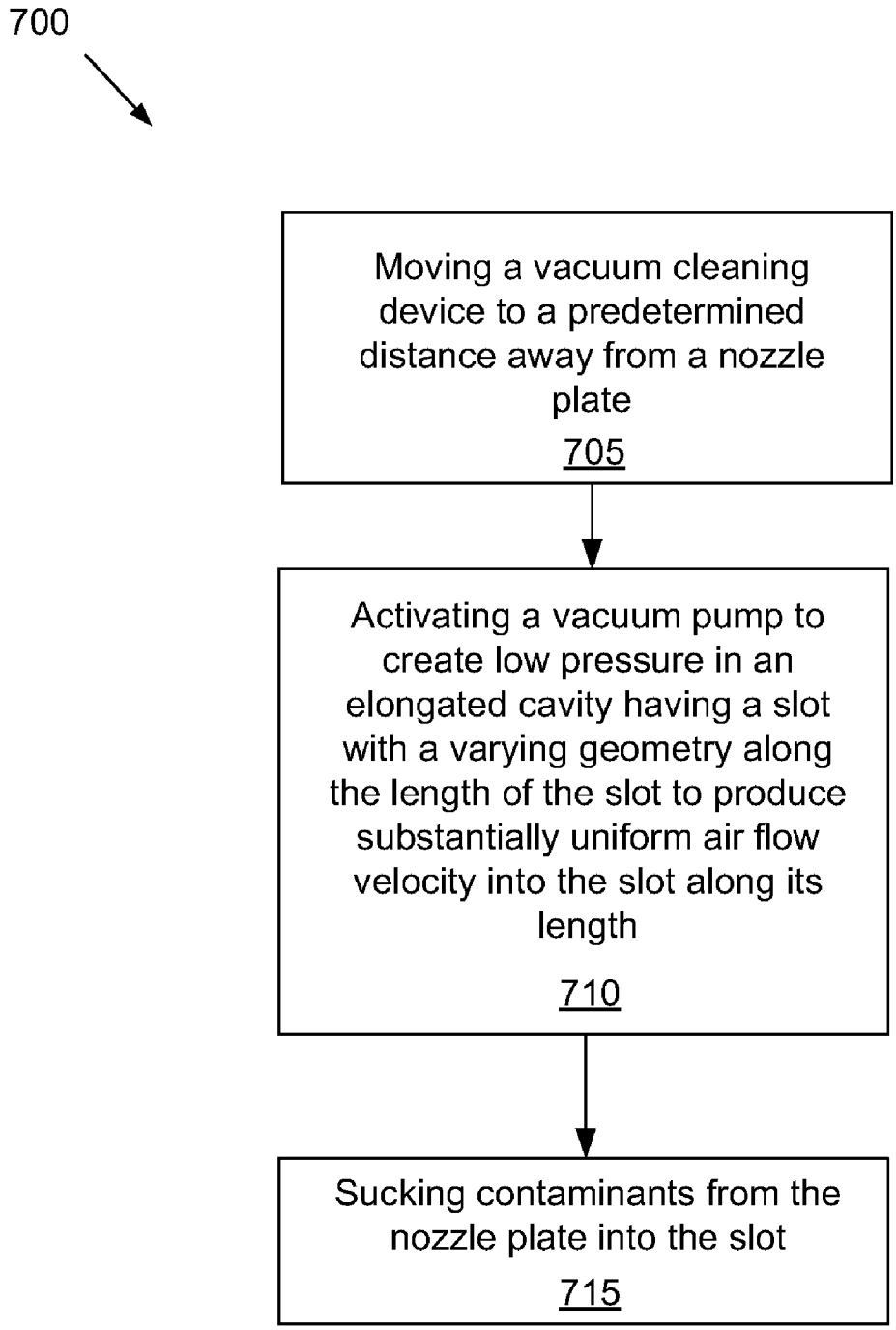
FIG. 7 is a flowchart of an illustrative method for non-contact inkjet print head cleaning, according to one example of principles described herein.

FIG. 7 is a flowchart of an illustrative method (700) for non-contact inkjet print head cleaning. The method includes moving a vacuum cleaning device a predetermined distance away from a nozzle plate (block 705). The vacuum cleaning device may be configured to clean the nozzle plates of a plurality of inkjet print heads. The predetermined distance ensures that the vacuum cleaning device does not contact any of the nozzle plates but is close enough to the nozzle plates to effectively clean the nozzle plates by sucking the contaminants from nozzle plates.

A vacuum pump is activated to create low pressure in an elongated cavity in the vacuum device. As used in the specification and appended claims, the term "low pressure" refers to reduced pressures that are below atmospheric pressure. The elongated cavity has a slot with a varying geometry along the length of the slot. The variations in the slot geometry produces substantially uniform air flow velocity into the slot along its length (block 710). As used in the specification and appended claims, the term "substantially uniform air flow velocity" or "airflow with a substantially uniform velocity" refers to air flows produced along a slot with variations of less than ±20%. For example, an air flow with velocity variations of less than ±10% is a substantially uniform air flow velocity.

Contaminants are sucked from the nozzle plate into the slot (block 715). The contaminants include liquids, dust, ink particulates, paper fibers, fabric lint and other undesired particulates. The contaminants may remain in the elongated cavity or pass through the vacuum port. The contaminants may be filtered from the air prior to reaching the vacuum pump.

Figure 8:
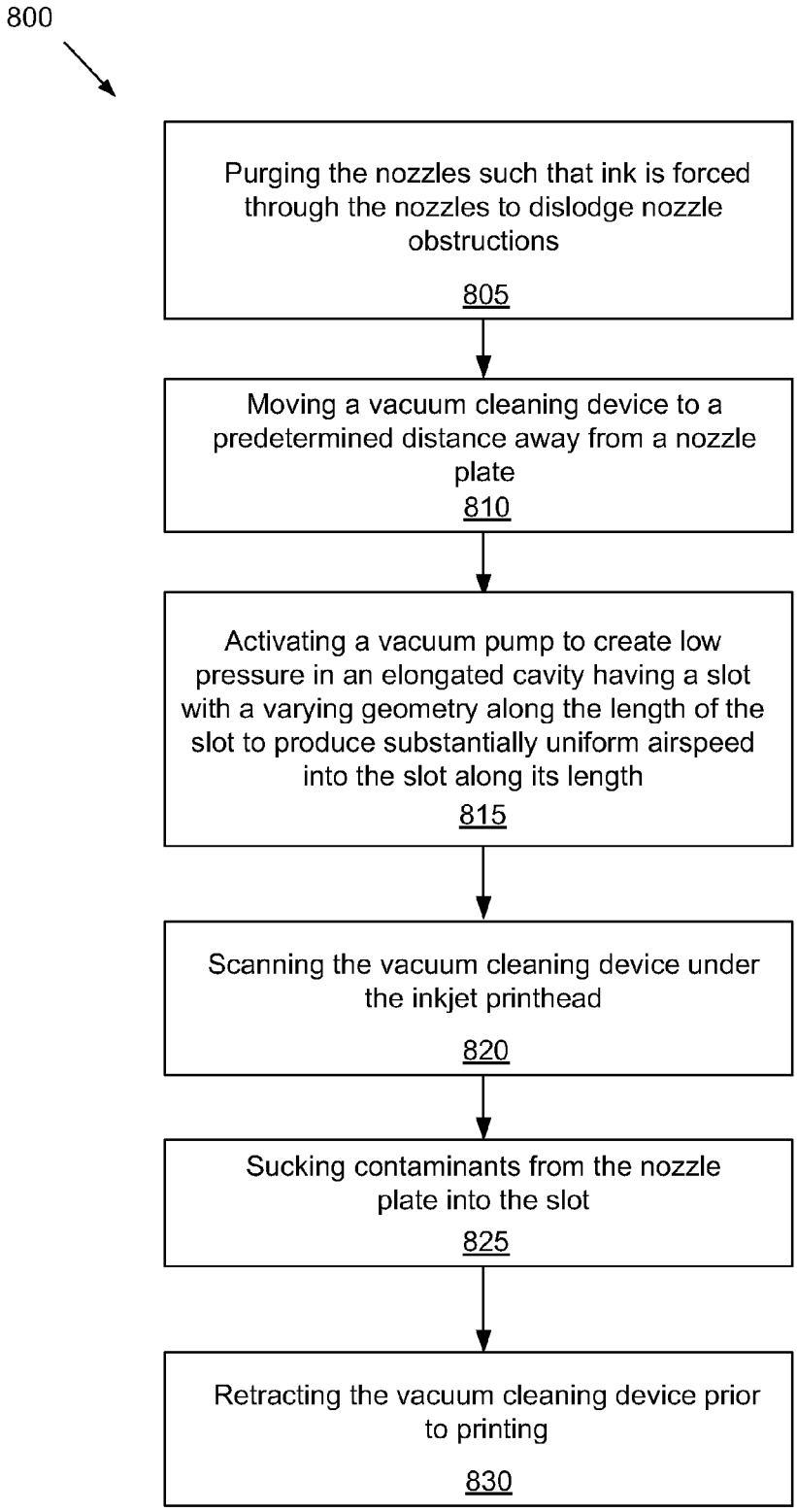
FIG. 8 is a flowchart of an illustrative method for non-contact inkjet print head cleaning, according to one example of principles described above.

FIG. 8 is a flowchart on an illustrative method (800) for non-contact inkjet print head cleaning. In this example, the method includes purging the nozzles such that ink is forced through the nozzles to dislodge nozzle obstructions (block 805). As discussed above, the vacuum cleaning device is moved a predetermined distance away from a nozzle plate (block 810). A vacuum pump is activated to create low pressure in an elongated cavity with a slot having a varying geometry that produces substantially uniform air flow velocity into the slot along its length (block 815). The vacuum cleaning device is scanned under the print head (block 820) and sucks the contaminants from the nozzle plates into the slot (block 825). In one example, the vacuum cleaning device simultaneously cleans nozzle plates on multiple inkjet print heads and moves over additional nozzle plates during scanning. The vacuum cleaning device is retracted prior to printing (block 830).

The cleaning methods described above could be performed when the performance of the printer begins to degrade, at a specific time during the printing cycle, or on a periodic basis. For preventive maintenance, the non-contact print head nozzle plate surface cleaning may be performed at the beginning or end of each printing cycle. Similarly, the non-contact cleaning may occur more frequently, such as at the end or beginning of each scanning pass. Periodical cleaning not related to any specific cycle is also possible, although it may reduce the machine throughput. The vacuum cleaning station may be implemented as a static station where the block of print heads travels relative to it or may be implemented as a scanning arrangement where vacuum device travels relative to the nozzle plates.

The methods described above are only illustrative examples of methods for non-contact cleaning of inkjet print heads. Blocks in the illustrative methods may be reordered, omitted, added or combined. For example, it may be desirable to bring the vacuum cleaning device close to the nozzle plates and activate the vacuum pump prior to purging the nozzles. By having the vacuum cleaning device operating prior to purging the nozzles, the excess ink ejected during the purging process can be immediately sucked into the vacuum cleaning device. This can minimize mist, overspray, and drips created by the purging process.

In conclusion, a non-contact vacuum device simultaneously cleans multiple print head arrays, such as those used in the HP Scitex 7500 flat bed printer. By using a non-contact method for cleaning the print heads, abrasion and cross contamination is avoided. A suction slot in the vacuum device sucks ink residuals and debris from the nozzle plate. In one example, the vacuum is generated by a vacuum port located at one end of an elongated cavity. Air is sucked into the cavity through a slot in a cavity wall. The slot geometry is designed so that there is substantially uniform airspeed into the slot along its length. In one example, the slot geometry is narrower near the vacuum port and becomes increasingly wider along its length. Other dimensions of the slot may also be varied, such as the slot depth and taper. The uniform airspeed created by the changing geometry of the slot increases the effectiveness in removing debris along the length of the slot.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A non-contact print head cleaning device comprises:

an elongated cavity underlying a print head;

a vacuum port connected to the elongated cavity to generate a low pressure in the elongated cavity; and a slot in a wall of the elongated cavity, a geometry of the slot varying along a length of the slot to produce an airflow with a substantially uniform velocity into the slot along its length to suck contaminants off the print head into the slot.

2. The device of claim 1, in which the vacuum port comprises a single vacuum port connected to one end of the elongated cavity.

3. The device of claim 1, in which the slot has a varying width along its length, the narrowest portion of the slot being closest to the vacuum port and the widest portion of the slot being farthest away from the vacuum port, the width of the widest portion of the slot being less than 2 millimeters.

4. The device of claim 1, in which the slot comprises a taper between an interior side of the slot and an exterior side of the slot.

5. The device of claim 4, in which the taper angle varies along the length of the slot.

6. The device of claim 1, in which the slot comprises a depth which varies along the length of the slot.

7. The device of claim 1, in which the cleaning device is brought to a predetermined distance away from a nozzle plate in the print head to constrain an air flow between an upper surface of the cleaning device and the nozzle plate.

8. The device of claim 1, in which a length of the cleaning device spans a plurality of print bars.

9. The device of claim 8, further comprising a scanning mechanism to move the cleaning device under the plurality of print bars.

10. The device of claim 9, in which the cleaning device is configured to be positioned substantially perpendicular to the plurality of print bars and configured to be scanned along a length of the print bars.

11. A method for cleaning inkjet print heads comprising:

moving a vacuum cleaning device to a predetermined distance away from a nozzle plate;

activating a vacuum pump to create low pressure in an elongated cavity having a slot with a varying geometry along its length to produce substantially uniform airspeed into the slot along its length; and sucking contaminants from the nozzle plate into the slot.

12. The method of claim 11, further comprising scanning the vacuum cleaning device under the inkjet print head.

13. The method of claim 11, further comprising purging the nozzles such that ink is forced through the nozzles to dislodge nozzle obstructions, in which the vacuum cleaning device removes excess ink from the nozzle plates.

14. The method of claim 11, In which the vacuum cleaning device spans multiple print heads such that the vacuum device simultaneously cleans the multiple print heads.

15. The method of claim 11, further comprising retracting the vacuum cleaning device prior to printing.

16. A device comprising:

a slot underlying a print head;

a single vacuum port for generating a reduced pressure beneath the slot; in which an aerodynamic resistance of the slot varies along the slot length to produce an airflow with a substantially uniform velocity into the slot along the slot length to suck contaminants off the print head into the slot.

17. The device of claim 16, in which the length of the slot spans a plurality of print bars, each print bar comprising an array of print heads.

18. The device of claim 17, further comprising a scanning mechanism to move the device along a length of the plurality of print bars.

19. The device of claim 16, in which the aerodynamic resistance of the slot is varied by changing at least one of: a slot width, a slot taper angle, and a slot depth.

20. The device of claim 19, in which the width of the slot varies along its length, the narrowest portion of the slot being closest to the vacuum port and the widest portion of the slot being farthest away from the vacuum port, the width of the widest portion of the slot being less than 2 millimeters.

* * * * *